US006045159A

United States Patent [19]

Bellah

[11] Patent Number: 6,045,159

[45] Date of Patent: Apr. 4, 2000

[54] BOOK HOLDER

[75] Inventor: Charlie L. Bellah, Nueces County, Tex.

[73] Assignee: DarCat Corp., Cheyenne, Wyo.

[21] Appl. No.: 09/013,161

[22] Filed: Jan. 25, 1998

[51] Int. Cl.[7] ..... B42D 3/00

[52] U.S. Cl. ..... 281/29; 281/17; 281/19.1; 281/28; 281/37; 281/51

[58] Field of Search ..... 281/17, 19.1, 28, 281/37, 51, 29

[56] References Cited

U.S. PATENT DOCUMENTS

| | | | |
|---|---|---|---|
| 3,981,522 | 9/1976 | Bloom . | |
| 4,116,414 | 9/1978 | Robertson | 248/451 |
| 4,702,453 | 10/1987 | Bishop | 248/447.2 |
| 5,351,927 | 10/1994 | Howell | 248/444 |
| 5,690,309 | 11/1997 | Blum | 248/444 |
| 5,829,787 | 11/1998 | Newhouse, Jr. | 281/46 |

*Primary Examiner*—Andrea L. Pitts
*Assistant Examiner*—Monica Smith
*Attorney, Agent, or Firm*—G. Turner Moller

[57] ABSTRACT

A holder for a book, such as a paperback or hard cover book, comprises a stiff flat member creased to provide a central stationary panel corresponding to the spine of the book, and a pair of pivoted panels corresponding to the front and back of the book. A spring assembly comprises a plurality of long concave thin metal members connected together by a strip of tape and connected to the stiff flat member by a pop rivet. The ends of the springs are received by a pair of plastic sleeves which are stitched to the stiff flat member. The stiff flat member is covered by a vinyl sheet in such a way as to have a curved edge providing a radius of at least 1/16". A transparent strap connects to the opposite sides of the book holder and presses open pages of the book against the flat stiff member. The curved edge prevents the transparent strap from being cut by the book holder.

15 Claims, 2 Drawing Sheets

BOOK HOLDER

This invention is a holder for a book, either a paperback book or a hard cover book, which acts to hold the book in an open position.

BACKGROUND OF THE INVENTION

Book holders are known in the prior art for holding paperback or other books in an open position. Although there are many disclosures of book holders, a preferred type is spring loaded to hold the book open and has a transparent strap across the center of the book to keep the pages flat against the book holder in the open position. The user can turn the pages of the book simply by closing the book holder, which causes the transparent strap to move away from the book holder, so the page can be turned. When the book holder is again opened, the new page is under the transparent strap. In a closed position, the transparent strap wraps around the book holder and acts to hold it closed against the bias of the spring assembly. A book holder of this type is shown in U.S. Pat. No. 3,981,522 and it is this type of device that this invention most nearly relates. The disclosure of U.S. Pat. No. 3,981,522 is incorporated herein by reference.

SUMMARY OF THE INVENTION

This invention comprises a book holder having an internal backing providing a spine and a pair of panels pivoted relative to the spine. A plurality of springs, similar to the prior art, comprise several elongate concave spring members, similar in appearance to lengths of the retractable measuring ruler in a conventional carpenter's rule. Tape is wound about a central area of the springs and a fastener, such as a pop rivet, captivates the taped central area to the spine of the backing. The tape causes the springs to bend consistently adjacent to the junction of the panels and the spine.

The ends of the springs are received in open ended plastic sleeves connected to the panels. Opening the book holder causes the springs to shift inside the sleeves and retreat away from the closed end of the sleeves. Closing the book holder causes the springs to advance toward the closed end of the sleeves. The sleeves prevent the springs from damaging the stiffening panels inside the book holder and reduce any noise caused by the relative movement of the springs. The sleeves also prevent the springs from rotating a significant amount about the axis of the fastener which would impede moving the book holder to the closed position.

The backing is overlain by a cover comprising one panel covering the book side of the holder and another panel covering the back side of the holder. One of the panels, preferably the back side panel, overlaps the edge of the backing and is stitched or otherwise secured together. The advantage is that this provides a curved edge having a diameter of at least about ⅛" over which the transparent strap extends for reasons which will become apparent hereinafter.

A transparent strap is permanently connected at one end adjacent an edge of the book holder and extends across the book side. The other end of the transparent strap is releasably connected to the book holder in two locations, a first position adjacent the opposite edge of the book holder and a second position adjacent the same edge where the permanent connection is made. The transparent strap has several functions. In the open position of the book holder, the strap holds the book pages flat against the holder while allowing the user to read the print visible through the strap. In the closed position of the book holder where the panels overlie one another, the strap holds the panels in the closed position, against the biasing force of the springs. To turn the pages of the book, the reader moves the panels toward the closed position which moves the transparent strap away from the pages, turns the page of the book and allows the springs to move the panels toward the open position. In overall operation, this invention operates essentially the same as the book holder in U.S. Pat. No. 3,981,522.

One embodiment of the invention is directed to holding paperback books and another embodiment is directed to holding larger hard cover books.

It is an object of this invention to provide an improved book holder.

Another object of this invention is to provide a book holder having a set of concave springs biasing the holder to an open position and an improved assembly for mounting the springs.

A further object of this invention is to provide a book holder having a transparent strap extending across the middle of the book which is wrapped around a large radius edge to connect to the front of the book holder.

These and other objects and advantages of this invention will become more apparent as this description proceeds, reference being made to the accompanying drawings and appended claims.

DETAILED DESCRIPTION

Figure 1:
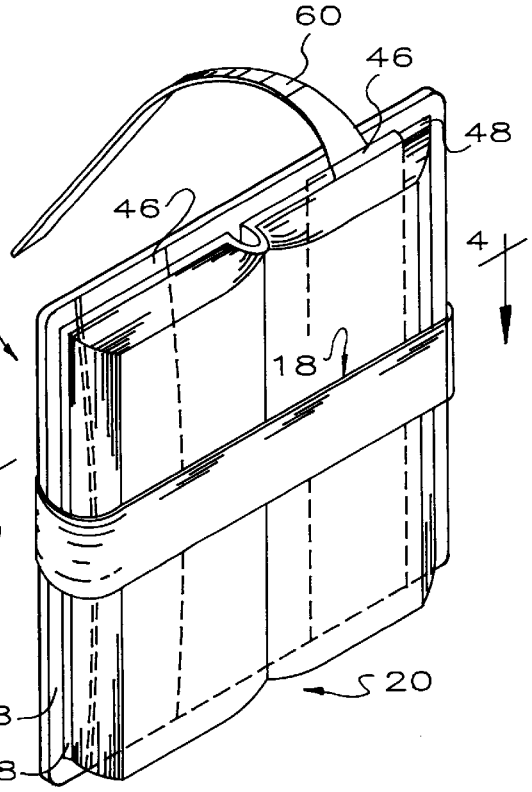
FIG. 1 is an isometric view of a book holder of this invention holding a book in the open position.

Referring to FIGS. 1–5, a book holder 10 of this invention comprises, as major components, a backing 12, a spring assembly 14, a cover 16 and a strap 18 for holding a book 20 in an open position as shown in FIG. 1 and in a closed position.

The backing 12 comprises a stiff sheet 22, such as cardboard or the like, which is creased along parallel lines 24 to provide a central spine 26 and a pair of panels 28. The creases 24 allow the panels 28 to pivot along parallel axes between the open position shown in FIG. 1 and a closed position where the panels 28 overlie one another.

The spring assembly 14 comprises a plurality of, and preferably three, concave elongate metallic spring members 30. The spring members 30 are analogous to lengths of a conventional retractable carpenter's rule and are connected to the spine 26 by a fastener 32 such as a pop rivet or the like. The fastener 32 not only connects the spring members 30 to the backing 12 but also hold the spring members 30 flat against the spine 26. There is some difficulty getting the spring members 30 to bend consistently at a location near the creases 24. To this end, a strip of tape 34 is wound around the spring members 30. The tape 34 may be of any suitable type, such as masking tape, reinforced Mylar or the like and terminates inside the creases 24 facilitating the spring members 30 bending adjacent the creases 24.

Figure 5:
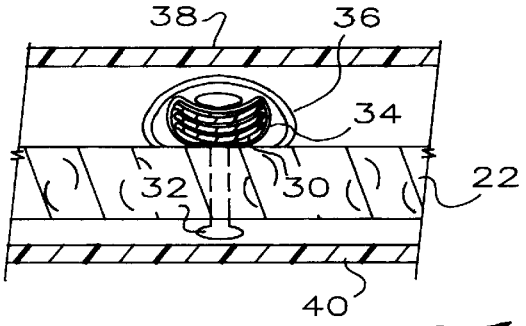
FIG. 5 is an enlarged cross-sectional view of the book holder of FIG. 4, taken substantially along line 5—5 thereof as viewed in the direction indicated by the arrows, the book being eliminated for purposes of illustration.
Figure 2:
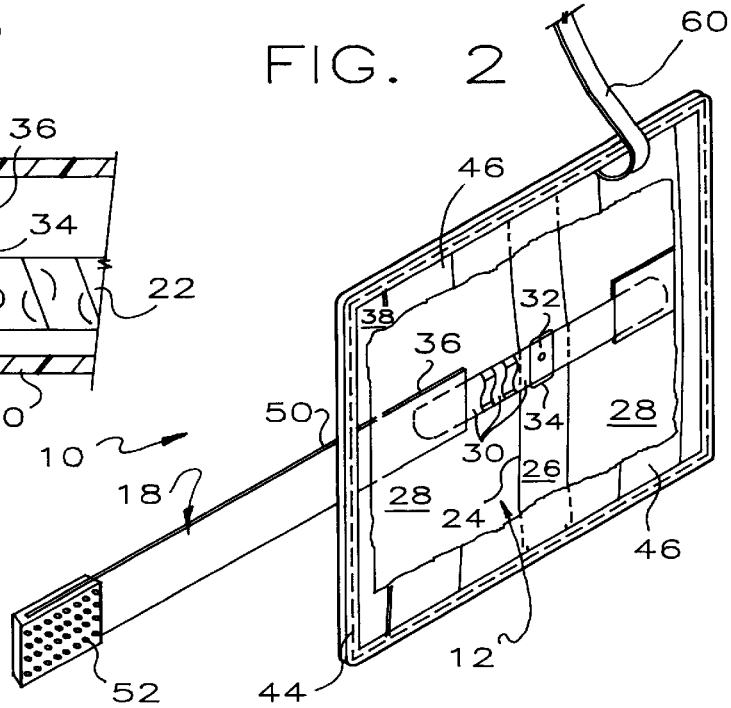
FIG. 2 is an isometric view of the book holder of FIG. 1, the central part of the cover being broken away to show the spring assembly.
Figure 4:
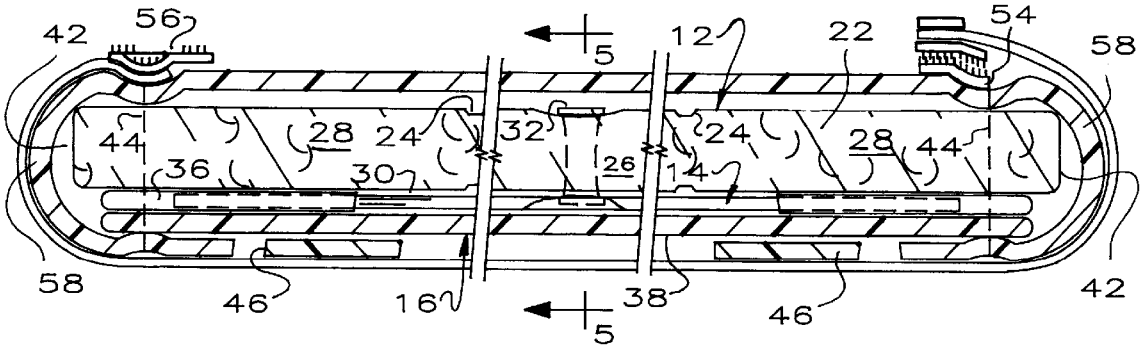
FIG. 4 is an enlarged cross-sectional view of the book holder of FIG. 1, taken substantially along line 4—4 thereof as viewed in the direction indicated by the arrows.

As shown in FIGS. 2 and 4, the ends of the spring members 30 extend into the open end of sleeves 36. The sleeves 36 protect the backing 12 from abrasion caused by movement of the ends of the spring members 30 relative to the backing 12 during opening and closing of the book holder 10. In addition, the sleeves 36 are considerably slicker than the backing 12 and cover 16 and thereby silences any noise caused by this relative movement. In addition, the sleeves 36 essentially prevent the spring members 30 from rotating about the axis of the fastener 32 and thereby ensure long, consistent operation of the book holder 10. It will be apparent that pivotal movement of the panels 28 along the creases 24 would be impeded if the spring members 30 were to rotate a substantial angle about the axis of the fastener 32.

The cover 16 is conveniently of a sturdy vinyl or other suitable material and comprises a book side section 38 and an external or back side section 40. The back side section 40 desirably wraps around the edges 42 of the backing 12 and overlies the book side section 38. A series of stitches 44 along the periphery of the book holder 10 connects the various components of the book holder 10 together. It will be noted that the ends of the sleeves 36 are thus stitched to the backing 12 although the sleeves 36 may be stitched to the backing 12 in a preliminary operation.

A strap 46 overlies each of the panels 28 and both ends are stitched to the cover 16. The covers 48 of the book 20 are slipped under the straps 46 thereby positioning the book 20 in the book holder 10. The straps 46 are preferably transparent because it is occasionally desirable to read information on the inside of the front and back covers 48.

Figure 3:
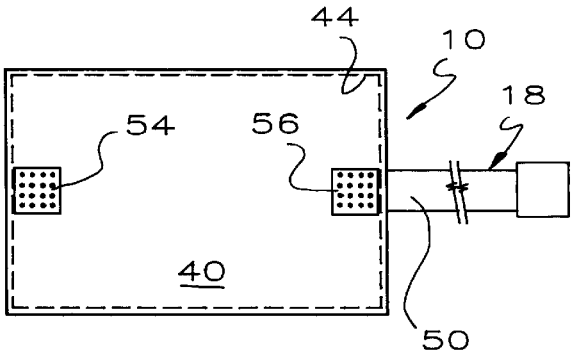
FIG. 3 is a back view of the book holder of FIGS. 1 and 2.

The strap 18 is a sturdy strap of transparent flexible plastic permanently attached at one end 50 to the cover 16 simply by placing it under the stitching 44. The free end of the strap 18 is provided with one pad 52 of a hook-and-loop fastener of which those sold under the trademark VELCRO are the most commonly known. On the back side section 40 are a pair of the mating pads 54, 56 of the hook-and-loop fastener. In the open position of the book holder 10, the strap 18 connects to the pad 54 as shown in FIGS. 3 and 4 to hold the pages of the book 20 open and flat against the cover 16. In the closed position, the strap 18 wraps around the book holder 10 and connects to the pad 56 thereby preventing the spring assembly 14 from biasing the holder to the open position. This allows the book 20 to be carried in a closed compact manner so it will fit in a pocket or purse.

An important feature of this invention is that the strap 18 wraps around the edges 58 of the cover 16 which have a curved surface of sufficient diameter to prevent early failure of the plastic material from fatigue. The edge 58 of the cover 16 is at least ⅛ inch in diameter and preferably is on the order of 2/10 inch in diameter. This allows the plastic strap 18 to bend over a sufficient radius to prevent premature failure of the material due to fatigue.

A book mark 60 preferably comprises a strip of transparent plastic connected at only one end to the cover 16, as by being under the stitching 44.

Use of the book holder 10 should now be apparent. In the open position, the front and back covers 48 of the book 20 are slipped under the straps 46 and the strap 18 is placed over the book side of the book 20 as shown in FIG. 1. After finishing a page, the reader closes the book holder 10 thereby loosening the strap 18, i.e. the strap 18 moves away from the book pages. The reader thumbs the next page to the left and reopens the book holder 10 thereby placing the strap 18 against the new page and exposing it for reading. When the reader wants to put the book holder 10 in a pocket or purse, the book mark 60 is put in position and the book holder 10 is closed, the strap 18 is detached from the pad 54, wrapped around the cover 16 and attached to the pad 56. In operation, it will be seen that the book holder 10 of this invention is identical to that in U.S. Pat. No. 3,981,522.

Figure 6:
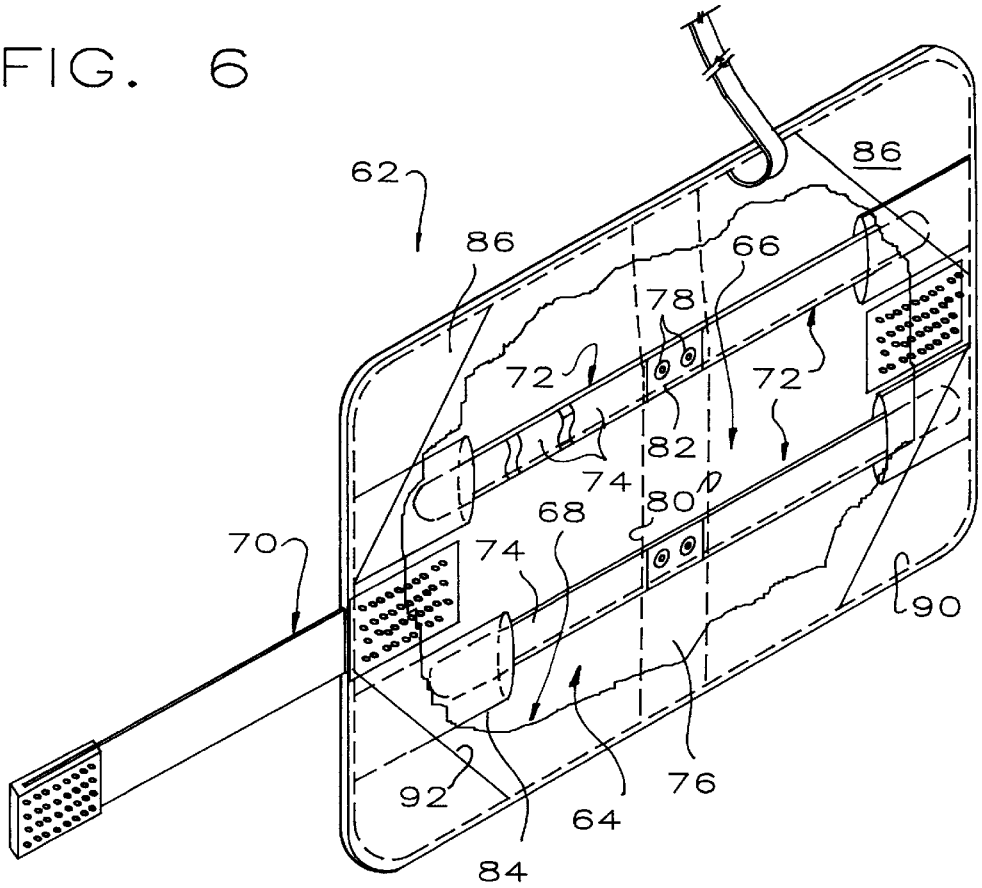
FIG. 6 is a broken isometric view, similar to FIG. 2, of another embodiment of the book holder of this invention.

The embodiment of FIGS. 1–5 will be recognized as being of a size to accommodate a standard paperback book. The same design is not well adapted for larger hard cover books for several reasons. Referring to FIG. 6, a book holder 62 is provided for larger hard cover books and comprises, as major components, a backing 64, a spring assembly 66, a cover 68 and a strap 70 for holding a hard cover book in an open position and in a closed position. Except for size, the book holder 62 is conveniently substantially identical to the book holder 10 except for two features. First, the force generated by the spring assembly 14 is insufficient to hold a large, heavy hard cover book open. Second, the straps 46 which captivate the cover 10 to the book 20 are not well adapted for hard cover books because the covers are not flexible enough to fit under straps positioned in this manner.

To overcome these difficulties, the spring assembly 66 comprises a pair of substantially identical subassemblies 72 which are very similar to the spring assembly 14. The subassemblies 72 each comprise a plurality of, and preferably three, concave elongate metallic spring members 74. The spring members 74 are analogous to lengths of a conventional retractable carpenter's rule and are connected to a spine 76 of the backing 64 by a pair of fasteners 78 such as a pop rivet or the like. Because the book holder 62 is designed for larger books, the spine 76 is somewhat wider than in the book holder 10.

The fasteners 78 not only connect the spring members 74 to the backing 64 but also hold the spring members 74 flat against the spine 76. There is some difficulty getting the spring members 74 to bend consistently at a location near the creases 80. In addition to a strip of tape 82 wound around the spring members 74, the fasteners 78 are spaced apart in a direction perpendicular to the creases 80 so one is near each of the creases 80. The tape 82 may be of any suitable type, such as masking tape, reinforced Mylar or the like and terminates inside the creases 80 facilitating the spring members 74 bending adjacent the creases 80.

The ends of the spring members 74 extend into the open end of sleeves 84. The sleeves 84 protect the backing 64 from abrasion caused by movement of the ends of the spring members 74 relative to the backing 64 during opening and closing of the book holder 62. In addition, the sleeves 84 are considerably slicker than the backing 64 and cover 68 and thereby silences any noise caused by this relative movement. In addition, the sleeves 84 essentially prevent the spring members 74 from rotating about the axis of the fastener 78 and thereby ensure long, consistent operation of the book holder 62. It will be apparent that pivotal movement of the panels 86 along the creases 80 would be impeded if the spring members 74 were to rotate a substantial angle about the axis of the fastener 78. It will accordingly be seen that the force generated by the spring assembly 66 is more than merely twice the force generated by the spring assembly 14 because the spring members 74 are considerably longer than the spring members 30.

Rather than using cover holding straps that extend parallel to the creases 80, a transparent plastic corner piece 88 is connected along perpendicular edges to the backing 64 in any suitable manner, as by being under the stitching 90. It will be seen that the diagonal edge 92 is unconnected to the backing 64 and is capable of receiving the corner of a hard cover book. It will be apparent that use of the book holder 62 is substantially identical to use of the book holder 10.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A holder for a book, comprising a backing including a stiff spine, a pair of pivoted panels corresponding to a front and a back of the book, and means pivotally mounting the panels along parallel axes relative to the spine between a first generally flat open position and a closed position where the panels overlie one another;

a spring assembly biasing the panels to the open position, including at least one thin elongate concave metal member having a first end, a second end and a central area between the first and second ends, means connecting the spring assembly to the spine including means wrapped around the central area causing the concave metal member to bend adjacent the parallel axes and a fastener extending through the central area and through the spine, first and second sleeves respectively receiving the first and second metal member ends, and means connecting the first and second sleeves to the panels;

a cover enclosing the panels and comprising a book side on which the book abuts and an exterior side; and a transparent flexible plastic strap for holding the book in an open position and for holding the holder in the closed position, the plastic strap being permanently connected to one edge of the cover and extending across the cover on the book side and means for releasably connecting the strap to an opposite edge of the cover.

2. The holder of claim 1 wherein the means wrapped around the central area comprises a strip of tape, the fastener extending through the strip of tape.

3. The holder of claim 1 wherein the means connecting the first and second sleeves to the panels comprises a row of stitching adjacent opposite edges of the panels.

4. The holder of claim 1 wherein the releasable connecting means comprising mating hook-and-loop pads adjacent a free end of the strap and on the cover.

5. The holder of claim 1 wherein the panels comprise ends of a stiff planar member having a pair of parallel spaced creases defining the parallel axes, the spine being between the parallel axes, the panels being connected to the spine along the creases, the mounting means including the creases.

6. The holder of claim 1 wherein the cover includes first and second parallel edges separating the book side and the exterior side and wherein the transparent plastic strap is permanently connected adjacent the first edge of the cover and extends across the cover on the book side and wherein the means releasably connecting the strap comprises means on the exterior side for releasably connecting the strap to the cover adjacent the second edge, the strap wrapping around the second edge of the cover in a location where the cover is at least ⅛ inch in diameter thereby reducing failure of the transparent strap due to fatigue.

7. The holder of claim 6 wherein the strap is permanently connected to the exterior side of the cover adjacent the first edge and wraps around the first edge of the cover a second location where the cover is at least ⅛ inch in diameter thereby reducing failure of the transparent strap due to fatigue.

8. The holder of claim 6 further comprising a second spring assembly parallel to the first mentioned spring assembly biasing the panels to the open position, including at least one thin elongate concave second metal member having a first end, a second end and a central area between the first and second ends, means connecting the second spring assembly to the spine including means wrapped around the central area causing the concave metal member to bend adjacent the parallel axes and a fastener extending through the central area and through the spine.

9. The book holder of claim 8 wherein the means connecting the second spring assembly to the spring comprises a pair of spaced apart fasteners, an imaginary line through the pair of spaced fasteners being substantially perpendicular to the axes.

10. A holder for a book, comprising a pair of pivoted panels corresponding to a front and a back of the book and means pivotally mounting the panels between a first generally flat open position and a closed position where the panels overlie one another;

a spring assembly biasing the panels toward the open position including at least one thin elongate concave metal member and means connecting the spring assembly to the panels;

a cover enclosing the panels and comprising a book side on which the book abuts, an exterior side, and first and second parallel edges separating the book side and the exterior side; and a transparent flexible plastic strap for holding the book in an open position and for holding the holder in the closed position, the plastic strap being permanently connected adjacent the first edge of the cover and extending across the cover on the book side and means on the exterior side for releasably connecting the strap to the cover, the strap wrapping around the second edge of the cover in a location where the cover edge is at least ⅛ inch in diameter thereby reducing failure of the transparent strap due to fatigue.

11. The holder of claim 10 wherein the strap is permanently connected to the exterior side of the cover adjacent the first edge and wraps around the first edge of the cover a second location where the cover is at least ⅛ inch is diameter thereby reducing failure of the transparent strap due to fatigue.

12. A holder for a book, comprising a backing including a stiff spine, a pair of pivoted panels corresponding to a front and a back of the book, and means pivotally mounting the panels along parallel axes relative to the spine between a first generally flat open position and a closed position where the panels overlie one another;

a spring assembly biasing the panels to the open position, including at least one thin elongate concave metal member having a first end adjacent a first of the panels, a second end adjacent a second of the panels and a central area between the first and second ends, means connecting the spring assembly to the spine including a fastener extending through the central area and through the spine, first and second plastic members abutting the first and second metal member ends providing a wear surface between the first and second metal member ends and the panels, and means connecting the first and second plastic members to the panels;

a cover enclosing the panels and comprising a book side on which the book abuts and an exterior side; and a transparent flexible plastic strap for holding the book in an open position and for holding the holder in the closed position, the plastic strap being permanently connected to one edge of the cover and extending across the cover on the book side and means for releasably connecting the strap to an opposite edge of the cover.

13. The holder of claim 12 further comprising tape wrapped around the central area of the metal member causing the concave metal member to bend adjacent the parallel axes.

14. The holder of claim 12 further comprising a second spring assembly parallel to the first mentioned spring assembly biasing the panels to the open position, including at least one thin elongate concave second metal member having a first end, a second end and a central area between the first and second ends, means connecting the second spring assembly to the spine including means wrapped around the central area causing the concave metal member to bend adjacent the parallel axes and a fastener extending through the central area and through the spine.

15. The book holder of claim 14 wherein the means connecting the second spring assembly to the spring comprises a pair of spaced apart fasteners, an imaginary line through the pair of spaced fasteners being substantially perpendicular to the axes.

* * * * *